US008567130B2

(12) United States Patent
Rhodes

(10) Patent No.: US 8,567,130 B2
(45) Date of Patent: Oct. 29, 2013

(54) ONE PIECE CORNER FITTING

(76) Inventor: John Winston Rhodes, London (CA)

( * ) Notice: Subject to any disclaimer, the term of this patent is extended or adjusted under 35 U.S.C. 154(b) by 0 days.

(21) Appl. No.: 13/548,699

(22) Filed: Jul. 13, 2012

(65) Prior Publication Data

US 2013/0014449 A1 Jan. 17, 2013

Related U.S. Application Data

(60) Provisional application No. 61/507,330, filed on Jul. 13, 2011.

(51) Int. Cl.
*E04D 13/076* (2006.01)

(52) U.S. Cl.
USPC ..... 52/14; 52/11; 52/58; 52/100

(58) Field of Classification Search
USPC ..... 52/58, 60, 100, 204.57, 272, 255, 52/287.1, 532, 631, 11, 12, 15, 16
See application file for complete search history.

(56) References Cited

U.S. PATENT DOCUMENTS

| | | | | |
|---|---|---|---|---|
| 2,013,207 | A * | 9/1935 | Hamm et al. | 52/800.16 |
| 2,884,669 | A * | 5/1959 | Hillson | 52/287.1 |
| 4,190,988 | A * | 3/1980 | Carreiro | 52/16 |
| 4,894,954 | A * | 1/1990 | Nozaki et al. | 49/479.1 |
| 5,155,938 | A * | 10/1992 | Nozaki | 49/441 |
| 5,718,084 | A * | 2/1998 | Takamiya | 49/440 |
| 5,749,192 | A * | 5/1998 | Menchetti | 52/489.1 |
| 5,921,056 | A * | 7/1999 | Weiss et al. | 52/745.16 |
| 6,243,989 | B1 * | 6/2001 | Nozaki | 49/479.1 |
| 6,681,530 | B1 * | 1/2004 | Givens | 52/58 |
| 6,996,936 | B1 * | 2/2006 | Maass | 49/479.1 |
| 7,373,729 | B2 * | 5/2008 | Mossot et al. | 33/527 |
| 7,937,904 | B2 * | 5/2011 | Davies | 52/656.1 |
| 2006/0168902 | A1 * | 8/2006 | Allen | 52/204.1 |
| 2008/0060314 | A1 * | 3/2008 | Davies | 52/656.4 |
| 2011/0047887 | A1 * | 3/2011 | Contreras | 52/12 |
| 2012/0068586 | A1 * | 3/2012 | Chen | 312/223.4 |

* cited by examiner

*Primary Examiner* — William Gilbert
*Assistant Examiner* — Alp Akbasli

(57) ABSTRACT

The present invention discloses a one piece corner fitting for a corner section of an eaves trough. The corner fitting of the present invention includes two arms designed to substantially fit within the corner section of the eaves trough, each arm including a back side wall configured to lie substantially adjacent a back side wall of the eaves trough corner section, a front side wall configured to lie substantially adjacent a front side wall of the eaves trough corner section and a bottom surface extending between the back side wall and the front side wall of the corner fitting, said back side wall front side wall and bottom surface forming a channel.

10 Claims, 10 Drawing Sheets

ONE PIECE CORNER FITTING

This application claims the benefit of the filing date of U.S. Provisional Application No. 61/507,330, filed Jul. 13, 2011 by the present inventor, the content of which is specifically incorporated herein by reference.

FIELD OF INVENTION

The present invention relates to eaves troughs or rain gutters, and more particularly to a one piece corner fitting for a corner section of a rain gutter or eaves trough.

BACKGROUND OF THE INVENTION

A rain gutter or eaves trough is a narrow channel, or trough, forming the component of a roof system which serves to collect and divert rainwater shed by the roof.

Rain gutters can be constructed from a variety of materials, including cast iron, lead, zinc, galvanized steel, painted steel, copper, painted aluminum, PVC (and other plastics), concrete, stone, and wood.

Water collected by a rain gutter is fed, usually via a downspout from the roof edge to the base of the building where it is either discharged or collected.

As illustrated in the photograph of FIG. 1, a common problem with gutters is that they can weaken and/or leak in time, particularly at the corner seams of the eaves trough. Leakage may arise from bad installation of gutter, settling of the house which my cause the corner sections of the gutter to separate apart (see FIG. 2), the channel of the gutter may slope away from the downspout thereby causing the water to pool in the corners, sagging of gutters at corners because nails were used that pull loose, and so forth. Leaves and/or other debris tend to accumulate at corner joint of the gutter due to rise of joint overlap and dams water at the corner joint.

These problems with gutters may result in: rot to the siding from dirt splashing on siding, rot in the rafter tails or fascia boards, insect infestation in the putrid pooled water and so forth.

One common solution for repairing a leaking gutter is sealing the gutter at the corners with some form of sealing solution or material. Common sealing solutions available on the market include silicones, roof cements like Black Jack™, and caulking materials. The disadvantage of using these common sealers to repair eaves trough systems is that they were designed as roof patch sealants, which do not adhere properly to the wet and dirty areas of the eaves trough or gutter allowing for air pockets through which water can seep and through temperature changes, the aluminum expands and contracts, causing the sealant to crack. As a result, these common sealants are not designed for a long repair term solution.

Another repair solution is the use of vinyl liners which have to be inserted along the channel of the eaves trough system. One disadvantage of these liners is that they are made of a thin vinyl (PVC) material which would tear when eaves troughs are cleaned and serviced. Another disadvantage of these liners is that the vinyl would deteriorate from extreme temperature changes causing leaks and the vinyl alone is ineffective without having end caps attached to the vinyl with one of the above mentioned sealants. The method of installing these liners is very labour intensive and a costly solution for both the installer and the consumer.

Another disadvantage with the liner repair systems and other repair systems available in the market is that to date the semi conforming, resilient liner is not UV rated to prevent deterioration. The liner does not also allow for the variances which may be found on eaves trough channel such as non removable debris and previously used sealants, which remain under the apparatus, as a result it requires an application of sealants to the entire area to complete the bonding, using sealants that have commonly been used and will continue to deteriorate as explained above.

One approach to stop the accumulation of debris is to provide a shield or cover which includes openings that will allow the passage of rainwater from the roof to the eaves trough while restricting the passage of debris such as leaves (see, for example, U.S. Pat. Nos. 6,098,344 and 6,944,992). Various parameters need to be taken into account when using these shields or covers, such as the size and number of apertures to permit the water to enter the eaves trough during heavy rains. These protectors need also to be secured directly to the gutter using fastening means, which must be removed to replace the gutter. These shields or covers do not serve to repair or protect damaged gutters.

What is needed is a system and/or device for protecting and/or repairing the corner unit of an eaves trough which may be easy to install, without the use of the common sealants mentioned above, light, inexpensive, which may be able to prevent leaks, and which may overcome the disadvantages of the repair systems and methods of the past.

SUMMARY OF THE INVENTION

In one embodiment the present invention provides for a one piece corner fitting designed to substantially fit within a corner section of an eaves trough The one piece corner fitting comprises two arms, each arm including a back side wall configured to lie substantially adjacent a back side wall of the eaves trough corner section, a front side wall configured to lie substantially adjacent a front side wall of the eaves trough corner section and a bottom surface extending between the side walls of the corner fitting, the bottom surface configured to lie in between the front side wall and the back side wall of the eaves trough corner section, said back side wall front side wall and bottom surface forming a channel.

In one embodiment of the one piece corner fitting, the bottom surface includes a shoulder area extending from the bottom surface and away from the channel, the shoulder area configured to lie substantially adjacent to a bottom wall of the eaves trough corner section.

In another embodiment of the one piece corner fitting the back wall includes an indented area extending into the channel.

In another embodiment of the one piece corner fitting the bottom surface includes marks for a sealant.

In another embodiment the one piece corner fitting of the present invention comprises a molded member.

In another embodiment, the present invention provides for a one piece corner fitting comprising a molded member designed to substantially fit within a corner section of an eaves trough, said molded member comprising two arms, each arm including a back side wall configured to lie substantially adjacent a back side wall of the eaves trough corner section, a front side wall configured to lie substantially adjacent a front side wall of the eaves trough corner section and a bottom surface extending between the side walls of the molded member, the bottom surface configured to lie in between the front side wall and the back side wall of the eaves trough corner section, said back side wall front side wall and bottom surface forming a channel.

In one embodiment, the bottom surface of the molded member includes two or more shoulders configured to lie substantially adjacent to a bottom wall of the eaves trough corner section and one or more recess areas between the two or more shoulders.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The invention will be better understood and objects of the invention will become apparent when consideration is given to the following detailed description thereof. Such description makes reference to the annexed drawings wherein.

Figure 1:
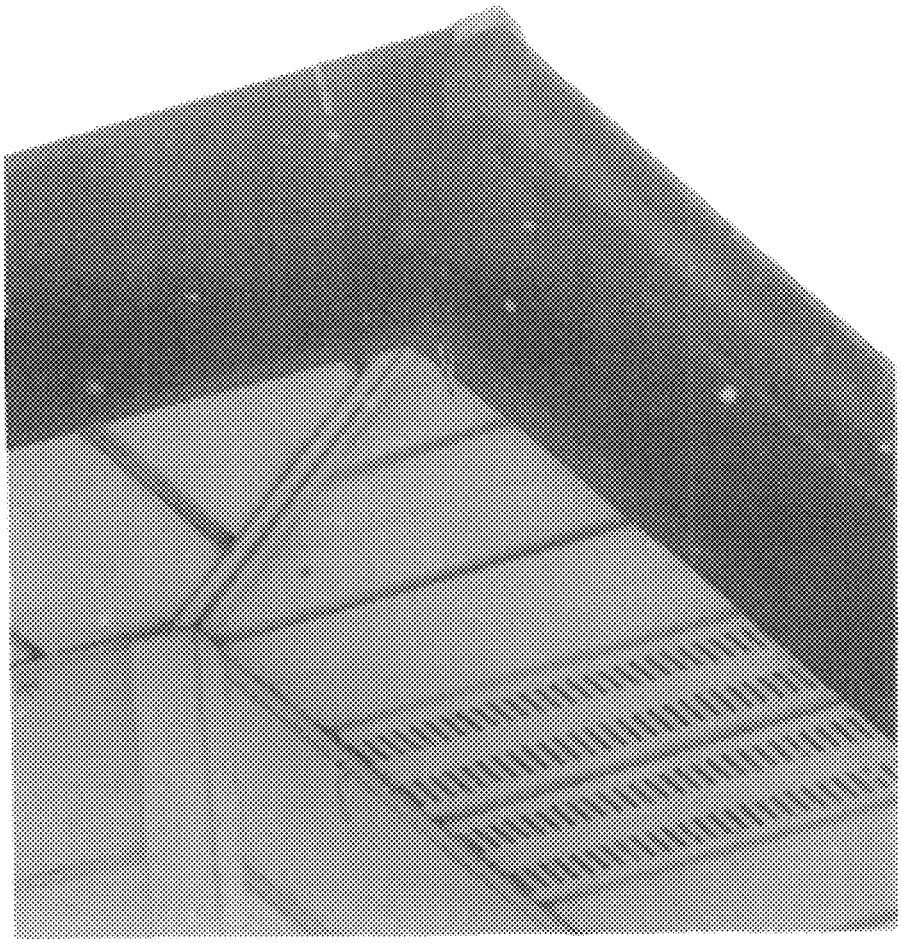
FIG. 1 is a photograph illustrating a bottom view of a leaking eaves trough corner section.
Figure 2:
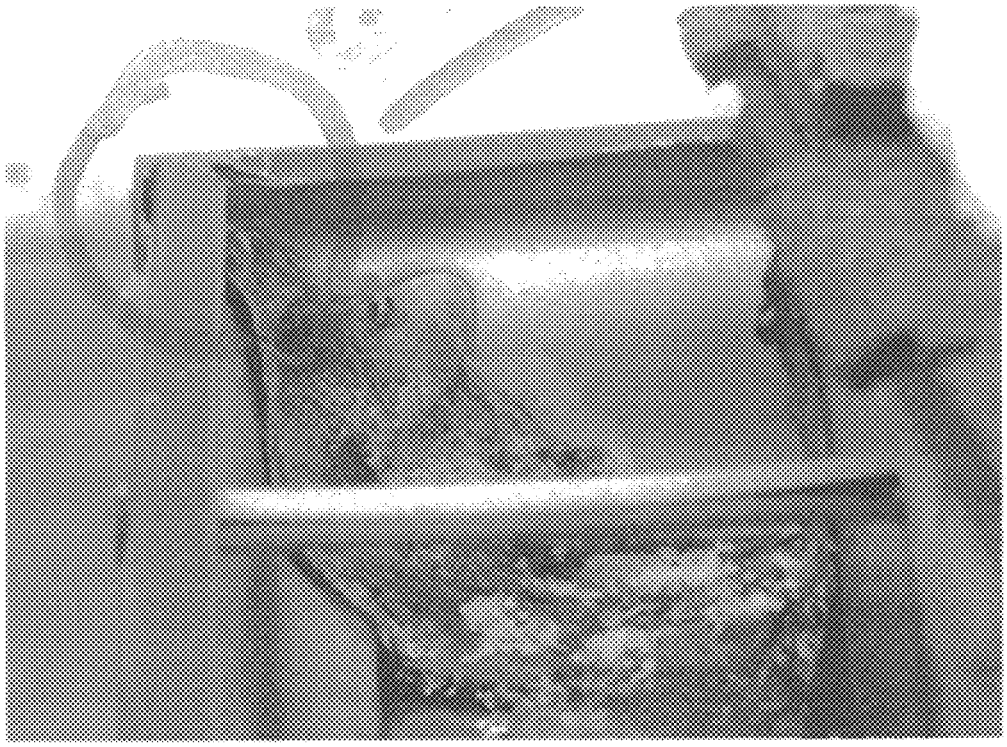
FIG. 2 is a photograph illustrating a top view of a corner section of leaking eaves trough.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE INVENTION

Overview

Unless defined otherwise, all technical and scientific terms used herein have the same meaning as commonly understood by one of ordinary skill in the art to which this invention belongs. Also, unless indicated otherwise, except within the claims, the use of "or" includes "and" and vice-versa. Non-limiting terms are not to be construed as limiting unless expressly stated or the context clearly indicates otherwise (for example "including", "having" and "comprising" typically indicate "including without limitation"). Singular forms including in the claims such as "a", "an" and "the" include the plural reference unless expressly stated otherwise.

The present invention discloses a one piece corner fitting for a corner section of an eaves trough. The one piece corner fitting may be used to repair an eaves trough corner section, or in other aspects may be used as a preventive measure to protect eaves trough corner sections from damage. The one piece corner fitting of the present invention may be a molded member which may be conveniently designed to substantially fit within a corner section of an eaves trough. The corner fitting of the present invention may include two arms, which may extend at right angles from a corner of the fitting. Each arm may include a back side wall, which may be configured to lie substantially adjacent a back side wall of the eaves trough corner section, a front side wall which may be configured to lie substantially adjacent a front side wall of the eaves trough corner section, and a base or bottom surface which may extend between the side walls of the fitting, the bottom surface may be configured to lie in between the front side wall and the back side wall of the eaves trough corner section. The back side wall, front side wall and bottom surface of the one piece corner fitting may form a channel. In one embodiment of the present invention, the bottom surface may have two or more shoulders configured to lie substantially adjacent to a bottom wall of the eaves trough corner section.

In one embodiment, the one piece corner fitting of the present invention may be made of a one piece unit which may substantially replicate the design of the actual eave trough or gutter corner section, it may totally encase the eave trough or gutter corner area and may snap into the existing eave trough or gutter corner to form a waterproof covering for the corners. In aspects of the present invention, the one piece corner fitting may be designed for use within the corner unit of the standard 5" eaves trough and gutter systems that are commonly used on homes and small commercial buildings.

The One Piece Corner Fitting

Eaves troughs commonly available in the market, such as the 5" K style gutters, include a vertical back or inner wall designed to lie substantially adjacent to a supporting structure, such as the eaves of a building, a substantially vertical front or outer wall and a horizontal base extending between the inner wall and the outer wall. The inner wall, outer wall and horizontal base define the eaves trough's channel. The inner wall may also include a top drip edge. The outer wall usually includes a lower vertical segment, a central arcuate segment and an upper vertical segment. The upper end of the upper vertical segment may be provided with an inwardly extending flange.

The invention will now be explained in details by referring to the figures.

Figure 3:
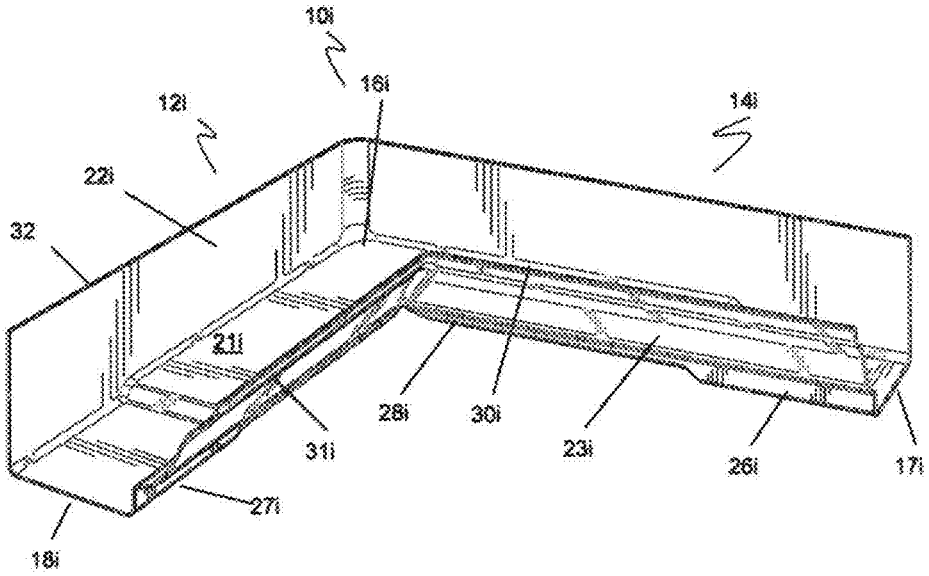
FIG. 3 is a graph illustrating a top perspective view of a one piece corner fitting for an inside corner of an eaves trough in accordance with one embodiment of the present invention.
Figure 4:
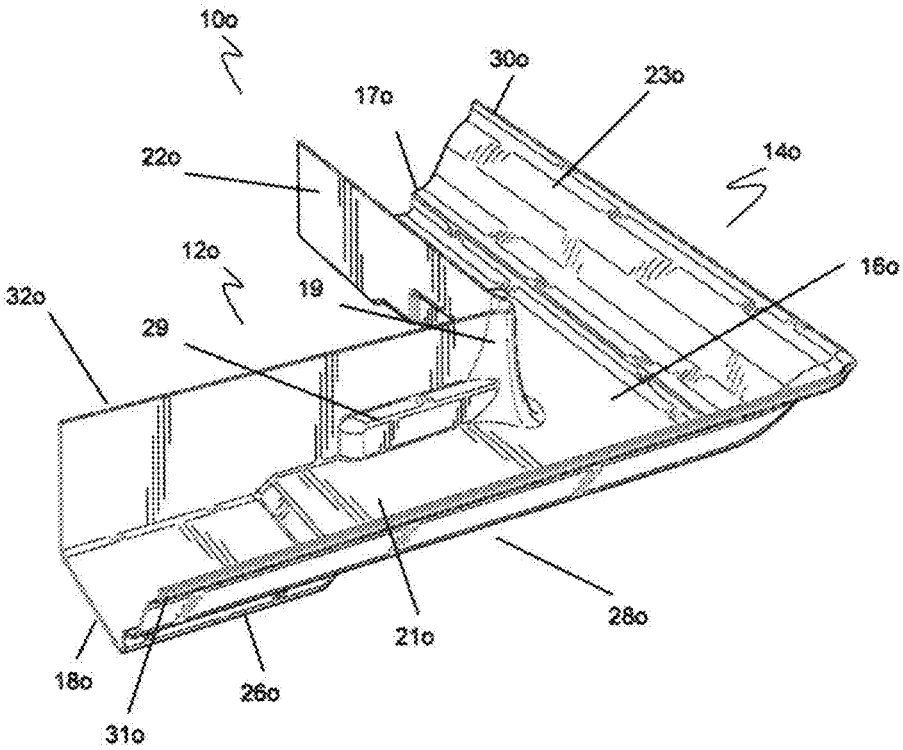
FIG. 4 is a graph illustrating a top perspective view of a one piece corner fitting for an outside corner of an eaves trough in accordance with one embodiment of the present invention.
Figure 5:
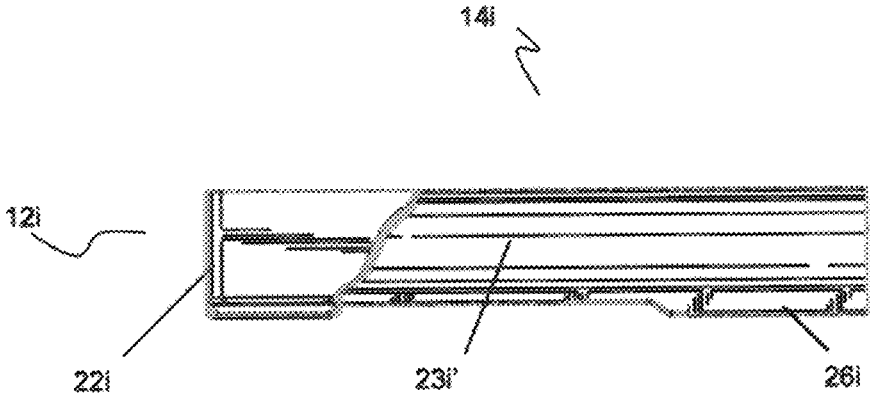
FIG. 5 is a graph illustrating a front view of the one piece corner fitting illustrated in FIG. 3.
Figure 6:
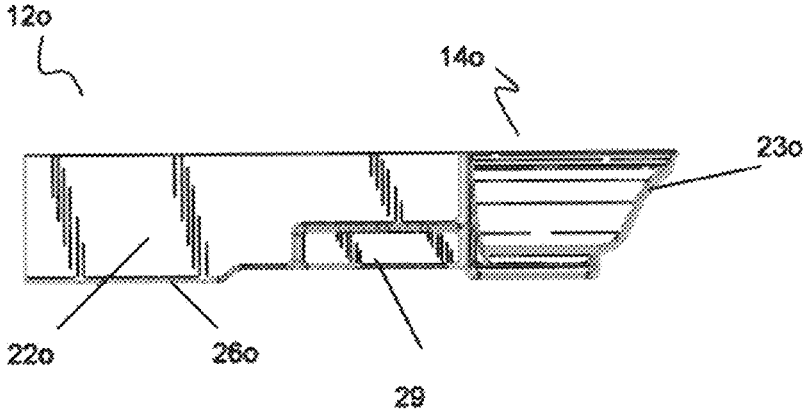
FIG. 6 is a graph illustrating a back view of the one piece corner fitting illustrated in FIG. 4.
Figure 7:
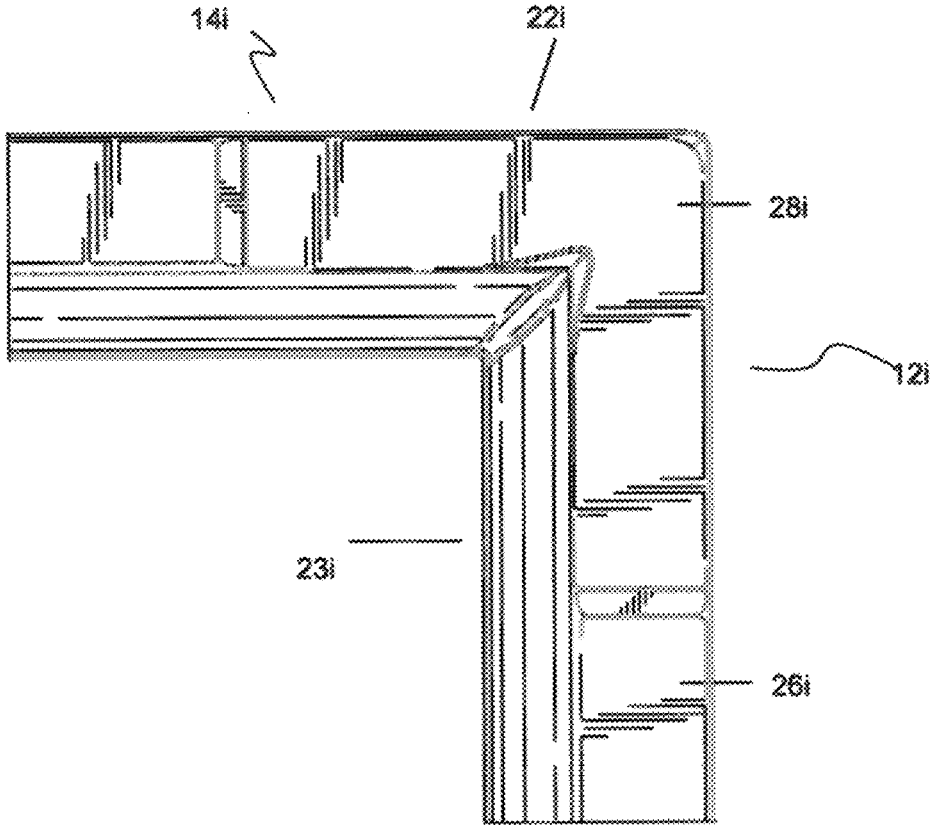
FIG. 7 is a graph illustrating a top plan view of the one piece corner fitting illustrated in FIG. 3.
Figure 8:
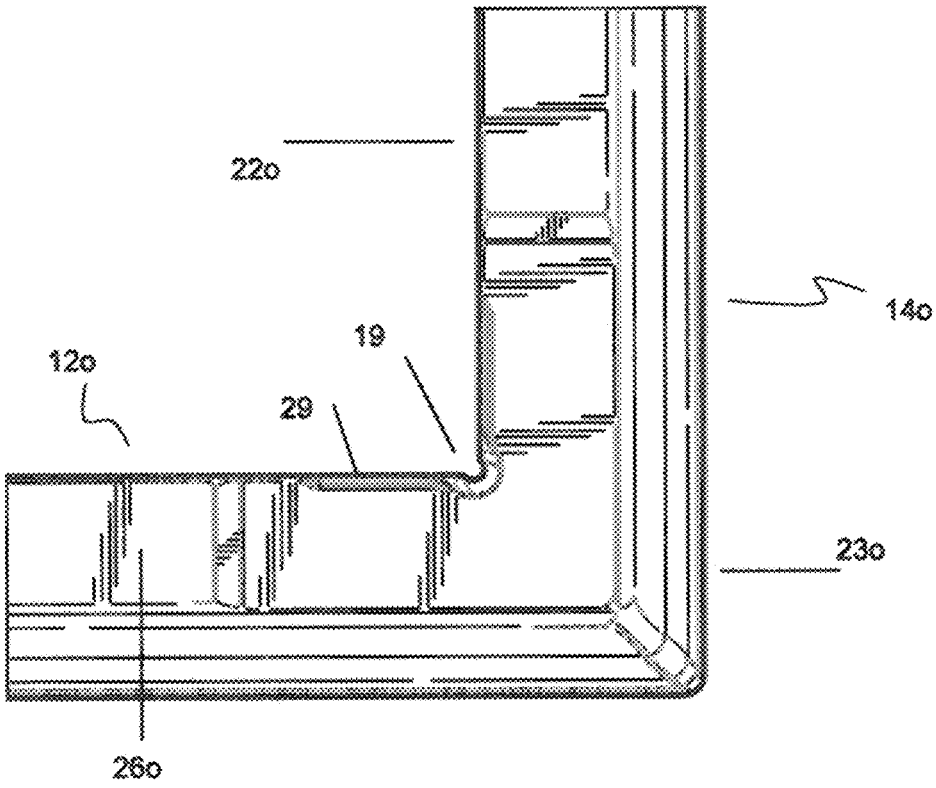
FIG. 8 is a graph illustrating a top plan view of the one piece corner fitting illustrated in FIG. 4.

The one piece corner fitting of the present invention may be designed for outside and inside corner sections of an eaves trough. FIGS. 3, 5 and 7 are graphs illustrating a one piece corner fitting 10*i* for an inside comes of an eaves trough. FIGS. 4, 6 and 8 are graphs illustrating a one piece corner fitting 10*o* for an outside corner of an eaves trough. For convenience in the figures the "i" following the reference numbers refers to "inside", and the "o" refers to outside.

With reference to FIGS. 3 to 8, one piece corner fittings 10*i,o* in accordance with one embodiment of the present invention are illustrated. The one piece corner fitting 10*i,o* may include two arms 12*i,o*, 14*i,o*. In one aspect, arms 12*i,o*, 14*i,o* may extend from each other so as to form a corner fitting. In one aspect of the present invention, arms 12*i,o*, 14*i,o* may extend at substantially right angles from a corner 16*i,o* to the end edge 17*i,o*, 18*i,o* of each arm 12*i,o*, 14*i,o*. In another aspect of the invention the two arms may form an angle other than a right angle to fit within an eaves trough corner having an angle other than a right angle. Arms 12*i,o*,

14*i,o* may include a back side wall 22*i,o*, a front side wall 23*i,o* and a horizontal floor 21*i,o* extending from said back side wall 22*i,o* to said front side wall 23*i,o*. Each arm 12*i,o*, 14*i,o* may have a length from the corner 16*i,o* to the end edges 17*i,o*, 18*i,o* to provide sufficient area for substantial adhesion of the arm to the eaves trough being repaired or protected, as it will be described below. For example, in one aspect, each arm 12*i,o*, 14*i,o* may be about 40 cm from corner to edge. It should be understood that arms of the corner fitting of the present invention may be more or less than about 40 cm as long as it provides sufficient adhesion area to the eaves trough being protected.

The one piece corner fitting may be conveniently designed to fit within a corner section of an eaves trough corner section. As such, back side walls 22*i,o* may be configured and designed to lie substantially adjacent the inner wall of a rain eaves trough. The front side walls 23*i,o* may be configured and designed to lie substantially adjacent the outer wall of the eaves trough.

Front side walls 23*i,o* may include a top edge 30*i,o* which may include a top lip 31*i,o*. Top lip 31 may be configured to fit within the inwardly extending flange of a conventional eaves trough. Front side walls 23*i,o* may also be designed to substantially conform to the lower vertical segment, central arcuate segment and upper vertical segments of a conventional 5" K style eaves trough. Back side walls 22*i,o* may include a top edge 32.

In one embodiment of the one piece corner fittings 10*i,o* of the present invention, the floor 21*i,o* may include peripheral areas or shoulders 26*i,o*, 27*i,o* extending from the floor 20*i,o* at the end of each arm 12*i,o*, 14*i,o*, and a raised area or recess 28*i,o* there in between shoulders 26*i,o*, 27*i,o*. Shoulders 26*i,o*, 27*i,o* may be configured and designed to lie substantially adjacent to the bottom wall of the eaves trough. Recess area may be configured to avoid rivets and screws which may have been used in the installation of the eaves trough. Recess may also serve to avoid debris accumulated at the corner of the eaves trough, or to avoid a rise of joint overlap at the corner joint of the gutter or to avoid any previously used sealants which may not be capable of being removed.

In one embodiment of the present invention, the back side walls 22 may include indented areas or pockets 29 protruding into the channel of the corner fitting of the present invention, as illustrated in FIGS. 4, 6 and 8. Pockets on the back side wall may be configured to avoid rivets, screws or other fastening means that may be present on the inner wall of the eaves trough which may have been used in the installation of the eaves trough. Pockets on the back side wall of the corner fitting of the present invention may also serve to avoid a rise of joint overlap at the joint of two pieces of the gutter or to avoid any previously used sealants which may not be capable of being removed. It should be understood that the one piece corner fitting of the present invention inside or outside corner may include zero, one or more than one pockets. It should also be understood that the position of these pockets may be positioned on different parts of the back side wall and that the figures illustrate just one example. For example, as illustrated in FIGS. 4 and 8, in one embodiment of the present invention, expanded corner areas 19 may be included. These expanded corner areas may also allows for rivets, screw and other debris.

Figure 9:
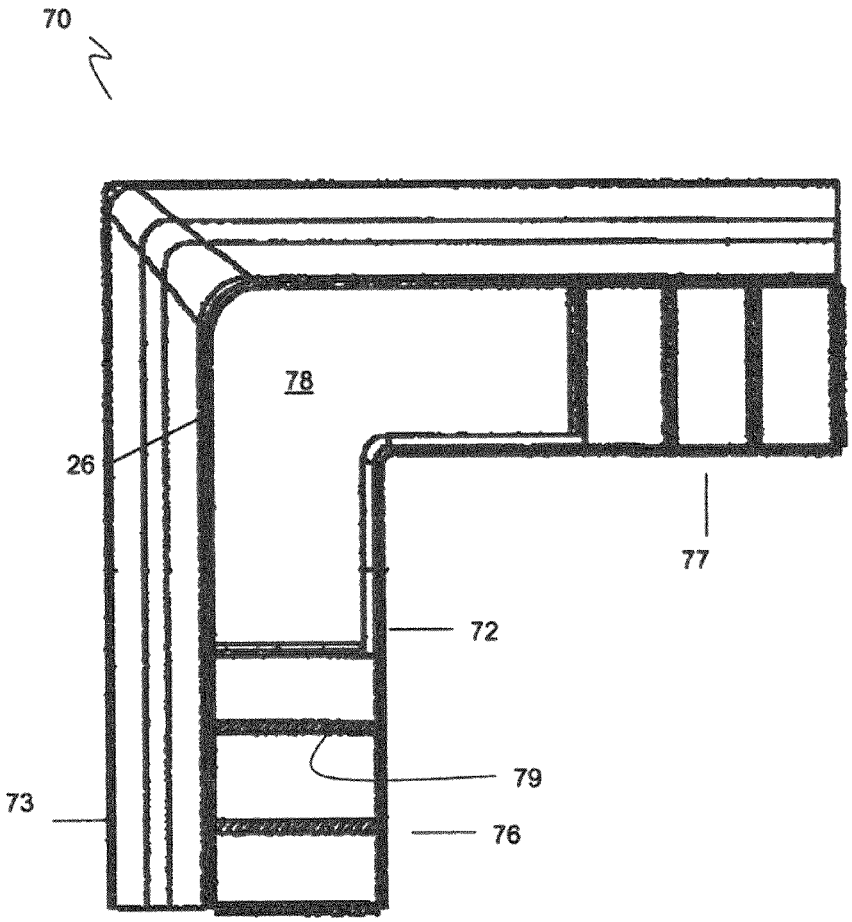
FIG. 9 is a graph illustrating a top view of a one piece corner fitting for an outside corner section of an eaves trough in accordance with one embodiment of the present invention.

FIG. 9 is a graph illustrating a top view of a one piece corner fitting 70 in accordance with in one embodiment of the present invention. Corner fitting 70 may include back side walls 72, front side walls 73, shoulders 76, 77 and recess area 78 in between shoulders 76, 77. To facilitate the installation of the one piece corner fitting of the present invention, the surface of shoulders 76, 77 may include marks or reference areas 79 for a sealant or adhesive which may serve to facilitate installation of the one piece corner fitting of the present invention.

The one piece fitting of the present invention may be made of any water impermeable material, UV rated material which may provide the flexibility and durability which may be required for this application. In one embodiment, the one piece fitting of the present invention may be made of a substantially resilient water impermeable material which may be capable to withstand corrosion. In aspects of the present invention, the one piece corner fitting of the present invention may be made of a material which may include one or more of the following properties: water impermeable, substantially resilient, capable of withstanding corrosion, UV rated, flexible to allow for thermal expansion and contraction, and having strength to withstand normal methods of cleaning an eaves trough. The material may not be less than forty thousands of an inch (0.040 in., about 0.1 cm), in thickness to provide durability and flexibility. It should be understood that the thickness of the material may be more or less than forty thousands of an inch (0.040 in., about 0.1 cm) thick as long as it provides sufficient durability and flexibility. Non-limiting examples of materials that may be used include ABS (acrylonitrile butadiene styrene) with UV rating.

Figure 10:
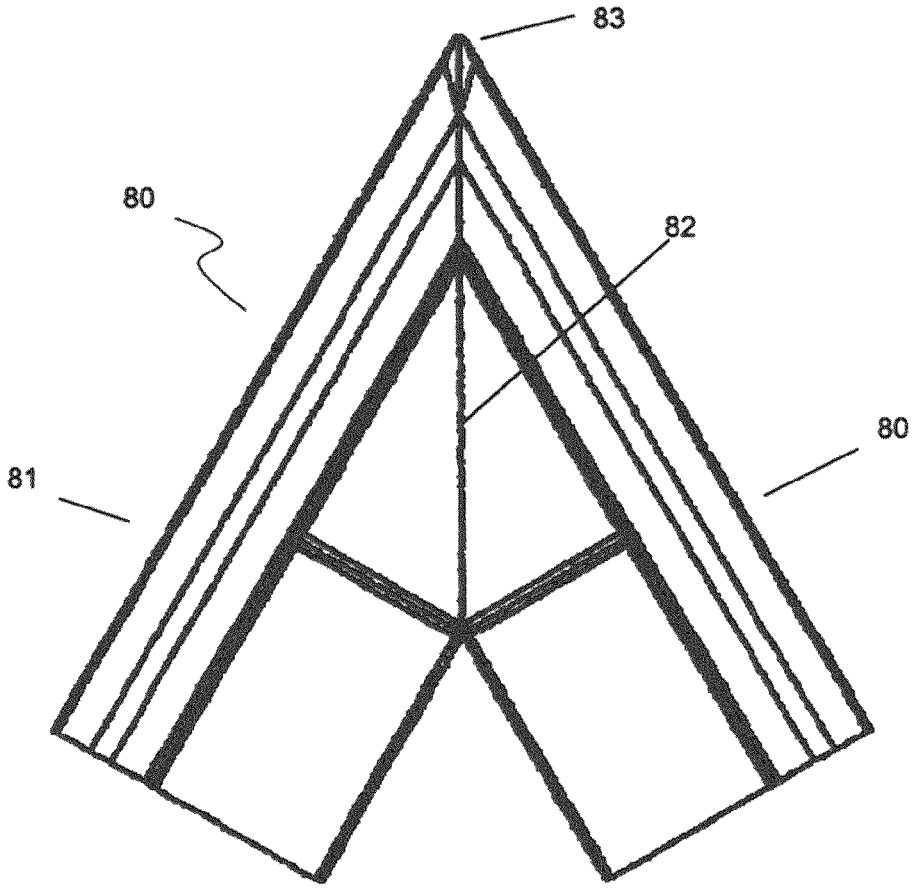
FIG. 10 is a graph illustrating a collapsed one piece corner fitting in accordance with one embodiment of the present invention.

By using a flexible material, the one piece corner fitting of the present invention may be squeezed, i.e. the arms of the corner fitting may be brought together. FIG. 10 is a graph illustrating a top view of a squeezed one piece corner fitting 80 forming a folded unit which may have a substantially 'V' shape accordance with in one embodiment of the present invention. FIG. 10 illustrates corner fitting 80 with two anus 80, 81 joined at corner 82, and having an apex 83.

Figure 11:
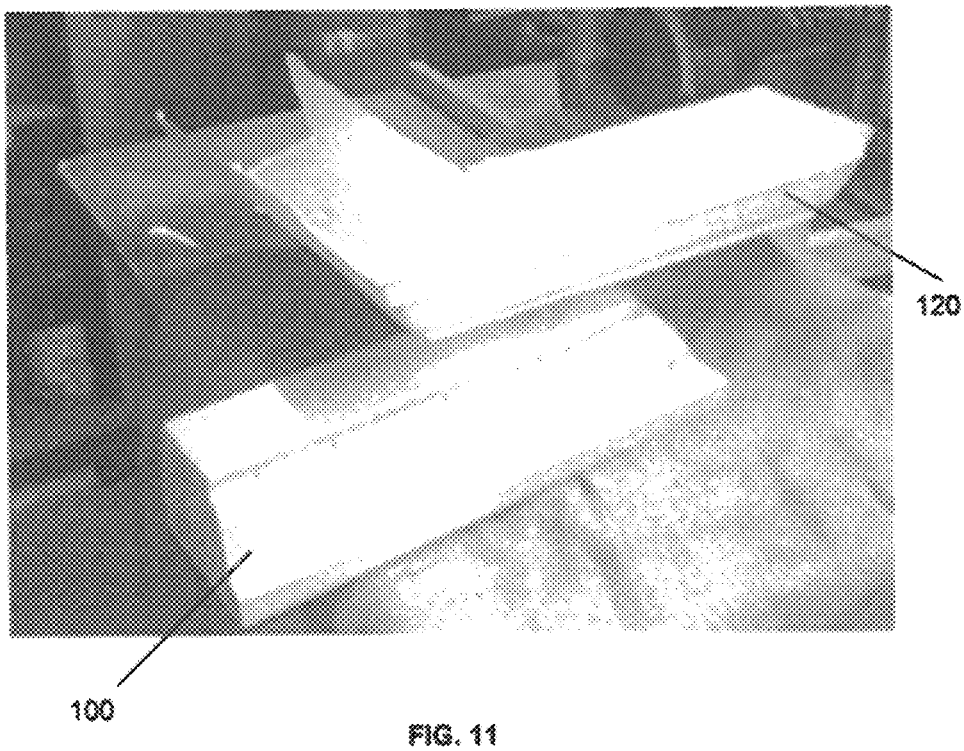
FIG. 11 is a photograph illustrating a die and a molded one piece corner fitting in accordance with one embodiment of the present invention.

The corner fitting of the present invention may be manufactured by any known method in the art, including plastic molding. FIG. 11 illustrates a corner die 100 and a molded corner fitting 120 produced from said corner die 100.

Installation

In another embodiment, the present invention provides for a method for installing the corner fitting of the present invention to a corner section of an eaves trough. The method may include the following steps: (a) bringing the two arms of the corner fitting together so as to form a folded unit having an apex, (b) pointing the apex of the folded unit to the corner of the eaves trough section being repaired or protected, and (c) releasing the two arms thereby allowing the corner fitting to sit down into the channel of the eaves trough.

In preparation for the installation of the apparatus of the present invention, the eaves trough and or gutter corner to be repaired or protected may be scraped and cleared of as much of the old sealants and debris as possible and then it may be wiped dry for better adhesion.

The following include at least a few of the steps which may be used for the installation of the eaves trough corner fitting of the present invention to an outside corner of an eaves trough:

1. Applying an adhesive to base of the channel of the eaves trough, such as a high performance gutter and eave trough like a thin set mortar. One may apply a sufficient amount of the adhesive thereby creating a thick and wide bead to the areas specified from one edge of the unit to the other. The adhesive may be a one-part high performance adhesive like Prolastic™, which may be able to handle temperature changes which may cause an aluminum rain gutter to expand or contract. The adhesive may create the waterproofing necessary to prevent leakage under the apparatus.

The areas for the adhesive application on the eave trough may be from where the corner unit may be attached to the eaves trough, from edge to edge and across the base to cover the area that the one-piece fitting of the present invention will cover from the raised area to the end of the apparatus extension, with a sufficient amount to allow the adhesive to spread when the apparatus is inserted, making a continuous skin coverage between the eave trough and the apparatus.

2. With hands on both sides of the flexible insert of the present invention, squeezing the unit together so as to form a folded unit which may have substantial 'V' shape as illustrated in FIG. 10. Holding the corner fitting of the present invention with its apex pointed towards the corner of the existing eaves trough or gutter corner.

3. Tipping the corner fitting down towards the corner of the existing gutter corner and allowing the corner fitting of the present invention to sit down into the channel of the gutter by applying pressure on the inside of the apparatus of the present invention on both sides of the corner, the top edge of the back wall of the apparatus may substantially align under the drip edge of the back side wall of the eaves trough and the corner fitting will slip into the front edge of the eaves trough lip.

4. Pushing down and running hands along the corner fitting's base and side walls so that the unit comes in substantial contact with the previously applied adhesive spreading the adhesive to create a clear skin effect under the unit.

5. Press fingers against and along the full length of the inner front lip of the eaves trough or gutter so that it snaps into place.

6. Applying the adhesive to the outer edges of the corner fitting starting at the top edge with a continuous flow of the adhesive across the base and up the other sides of the apparatus thereby sealing both open end areas, completing the waterproofing seal.

For an inside corner installation the installation procedure may be substantially similar as for the outside corner with the exception that upper edges may be reversed as seen in the attached drawings.

The above disclosure generally describes the present invention. Changes in form and substitution of equivalents are contemplated as circumstances may suggest or render expedient. Although specific terms have been employed herein, such terms are intended in a descriptive sense and not for purposes of limitation. Other variations and modifications of the invention are possible. As such modifications or variations are believed to be within the sphere and scope of the invention as defined by the claims appended hereto.

I claim:

1. A gutter insert, the gutter insert comprising two arms designed to substantially fit within the corner section of an eaves trough, each arm including: (a) a back side well configured to lie substantially adjacent a back side well of the eaves trough corner section, (b) a front side wall configured to lie substantially adjacent a front side wall of the eaves trough corner section, and (c) a bottom surface extending between the side walls of the gutter insert, the bottom surface configured to lie substantially adjacent to a base of the eaves trough corner section in between the front side wall and the back side wall of the eaves trough corner section, said back side wall, front side wall and bottom surface forming a channel of the gutter insert.

2. The gutter insert of claim 1, wherein said bottom surface includes a shoulder comprising a downwardly offset surface.

3. The gutter insert of claim 1, wherein said back side wall includes a recess that defines a pocket extending into the channel of the gutter insert.

4. The gutter insert of claim 2, wherein said back side wall includes a recess that defines a pocket extending into the channel of the gutter insert.

5. The gutter insert of claim 1, wherein said bottom surface includes marks for a sealant.

6. The gutter insert of claim 2, wherein said shoulder includes marks for a sealant.

7. The gutter insert of claim 1, wherein said one piece corner fitting comprises a molded member.

8. The gutter insert o claim 1, wherein the gutter is configured for an outside corner eaves trough section.

9. The gutter insert of claim 1, wherein the gutter is configured for an inside corner eaves trough corner section.

10. The gutter insert of claim 2, wherein the gutter insert includes more than one shoulders comprising downwardly offset surface, and wherein the more than one shoulders together provide co-planar shoulders arranged to support the gutter insert on the base of the eaves trough.

* * * * *